US011008159B2

(12) United States Patent
Bailey et al.

(10) Patent No.: US 11,008,159 B2
(45) Date of Patent: May 18, 2021

(54) EXTENSION COLLAR FOR A FLOWABLE MATERIAL DISPENSING BOX

(71) Applicant: Buckhorn, Inc., Milford, OH (US)

(72) Inventors: Scott Bailey, Cincinnati, OH (US); Eric Bellman, Amelia, OH (US); Jack Fillmore, Loveland, OH (US); Jason Gearhart, Westfield, IN (US)

(73) Assignee: Buckhorn, Inc., Milford, OH (US)

( * ) Notice: Subject to any disclaimer, the term of this patent is extended or adjusted under 35 U.S.C. 154(b) by 761 days.

(21) Appl. No.: 15/860,783

(22) Filed: Jan. 3, 2018

(65) Prior Publication Data

US 2019/0202630 A1 Jul. 4, 2019

(51) Int. Cl.

| | |
|---|---|
| ***B65D 6/34*** | (2006.01) |
| ***B65D 88/00*** | (2006.01) |
| ***B65D 88/02*** | (2006.01) |
| ***B65D 88/54*** | (2006.01) |
| ***B65D 19/18*** | (2006.01) |
| ***B65D 21/08*** | (2006.01) |

(52) U.S. Cl.

CPC ..... *B65D 88/005* (2013.01); *B65D 19/18* (2013.01); *B65D 21/083* (2013.01); *B65D 88/022* (2013.01); *B65D 88/54* (2013.01); *B65D 2519/00034* (2013.01); *B65D 2519/00069* (2013.01); *B65D 2519/00174* (2013.01); *B65D 2519/00208* (2013.01); *B65D 2519/00333* (2013.01); *B65D 2519/00402* (2013.01); *B65D 2519/00422* (2013.01); *B65D 2519/00497* (2013.01); *B65D 2519/00502* (2013.01); *B65D 2519/00621* (2013.01); *B65D 2519/00666* (2013.01); *B65D 2519/00711* (2013.01); *B65D 2519/00995* (2013.01)

(58) Field of Classification Search

CPC .. B65D 21/083; B65D 88/005; B65D 88/022; B65D 88/54; B65D 19/38; B65D 2519/00194

USPC ..... 220/694, 4.03; 206/501

See application file for complete search history.

(56) References Cited

U.S. PATENT DOCUMENTS

| | | | | |
|---|---|---|---|---|
| 6,010,022 A * | 1/2000 | Deaton | ..... | B65D 19/18 220/4.03 |
| 2014/0083896 A1* | 3/2014 | Park | ..... | B65D 21/083 206/503 |

* cited by examiner

*Primary Examiner* — King M Chu

(74) *Attorney, Agent, or Firm* — Benesch, Friedlander, Coplan & Aronoff LLP

(57) ABSTRACT

A hollow extension collar for a flowable material dispensing box, fits over a prior art dispensing box and can be locked in place to increase the enclosed volume incrementally. The incremental increase is determined by the height of walls from which the extension collar is formed. Multiple extension collars can be stacked on top of each other and filled with flowable material.

11 Claims, 14 Drawing Sheets

EXTENSION COLLAR FOR A FLOWABLE MATERIAL DISPENSING BOX

BACKGROUND

Flowable material dispensing boxes, also known as intermediate bulk containers (IBCs) or "hopper bins" are well known. An example of such a box is disclosed in U.S. Pat. No. 5,845,799 entitled, "Dispensing Gate for Knock Down Bulk Box," issued Dec. 8, 1998, the contents of which are incorporated herein by reference. Another similar dispensing box for flowable material is disclosed in U.S. Pat. No. 6,010,022, issued Jan. 4, 2000, and entitled "Dispensing Box for Flowable Material," the contents of which are also incorporated herein by reference.

Prior art dispensing boxes provide safe and secure containers for both granular materials such as corn, soybeans, gravel and the like. They also provide safe and secure handling for liquids.

It is well known that the prior art flowable material dispensing boxes have shapes that are substantially the same as a rectangular parallelepiped or they are cuboid. They can thus be abutted each other and stacked on top of each other for shipping purposes, maximizing the use of limited space in a shipping container such as truck, rail car or ship.

A problem with prior art flowable material boxes is the large enclosed volume of such containers is not always used or required by a shipper. Stated another way, when an integral multiple number of single flowable material boxes provides either two much or too little volume for a particular amount of material to transport, some volume in at least one container will be unnecessary and thus wasted. An apparatus and method for incrementally increasing the volume of a prior art flowable material container or dispensing box would be an improvement over the prior art.

DETAILED DESCRIPTION

As used herein, the word "concave" refers to a surface or structure that is hollowed or channeled inwardly. "Concave" also includes shapes that resemble the cross section of a common rain gutter or a flat-bottom trench.

"Convex" refers to a surface or structure shaped to extend outwardly and as used herein. As used herein, "convex" includes shapes that are essentially a mirror image or an inverse of a shape that is considered herein to be concave. An electrical square wave is thus an example of a shape that is considered to herein be convex.

The words "complement" and "complementary" refer to structures or surfaces, the shapes of which are inverses or mirror images of each other. A foot and shoe are considered herein to be complements of each other. A mortise and tenon are complements of each other.

A "shackle" is the hinged, sliding or swiveling loop-shaped member of a padlock. The heel of the shackle remains always in the padlock body. The "toe" of a shackle comes out when unlocked.

The word "mate" means to join or fit together.

Figure 1A:
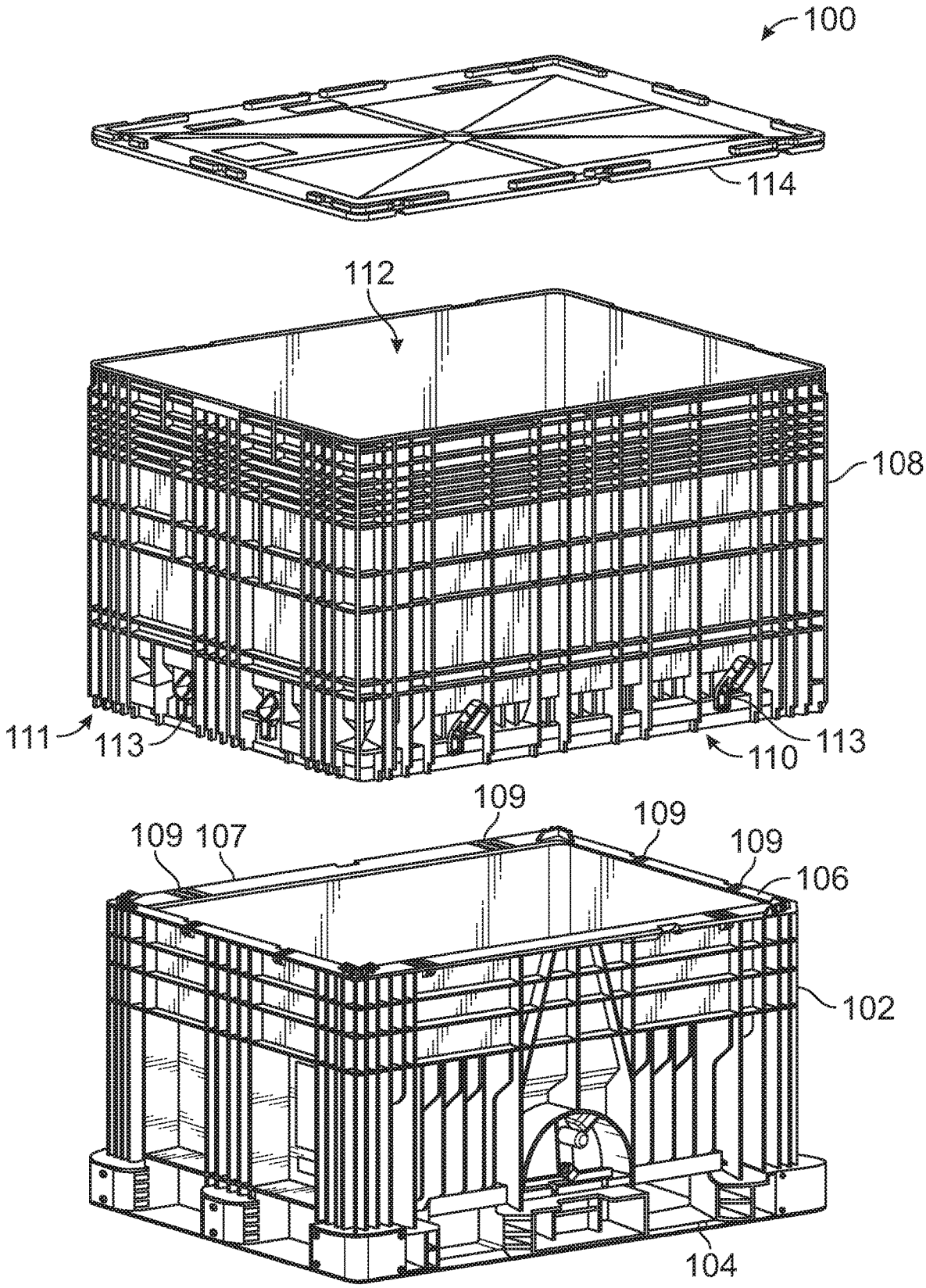
FIG. 1A (Prior Art)
FIG. 1A is an exploded view of a prior art, three-part container or dispensing box for flowable material, i.e., a "dispensing box" that comprises a base, a ring, and a cover.

Referring now to FIG. 1A, a prior art dispensing box for flowable material 100 (also referred to hereinafter as a "dispensing box") comprises a base portion 102, a ring portion 108, and a cover portion 114. See also the prior art patents incorporated herein by reference for a description of a dispensing box.

The base portion 102 has a bottom 104 and an open top 106. The base portion 102 also has inclined interior walls (not visible) that direct flowable contents of the dispensing box to an opening in the bottom of the base portion, (opening not shown in FIGS. 1A-1D), from which material in the dispensing box 100 is discharged. For claim construction purposes, the base portion thus has a closed bottom with a flow control door, four inclined walls and an open top through which material can pass into the base portion. The open top of the base portion of the dispensing box has a top edge portion formed to have a shape that can mate with a ring portion described below.

In FIG. 1A, the ring portion 108 has an open bottom 110 and an open top 112. The ring portion 108 is sized and shaped so that it can sit atop the open top 106 of the base portion 102 by virtue of a bottom edge 111 that is sized and shaped to mate with, and rest on top of, the top edge 107 of the base portion 102.

The ring portion 108 is so named because its inside dimensions (not shown) are selected to permit the ring portion 108 to be slid over the base portion 102 when the ring portion 108 is flipped over or inverted from its orientation shown in FIG. 1A. When the ring portion 108 is "upright" (as shown in FIG. 1A), it sits on top of the base portion 102, and can be locked or attached to the base portion 102 using latches 113 in the bottom of the ring portion 108 that engage mortises 109 formed in the top edge 107 of the base portion 102.

Figure 1B:
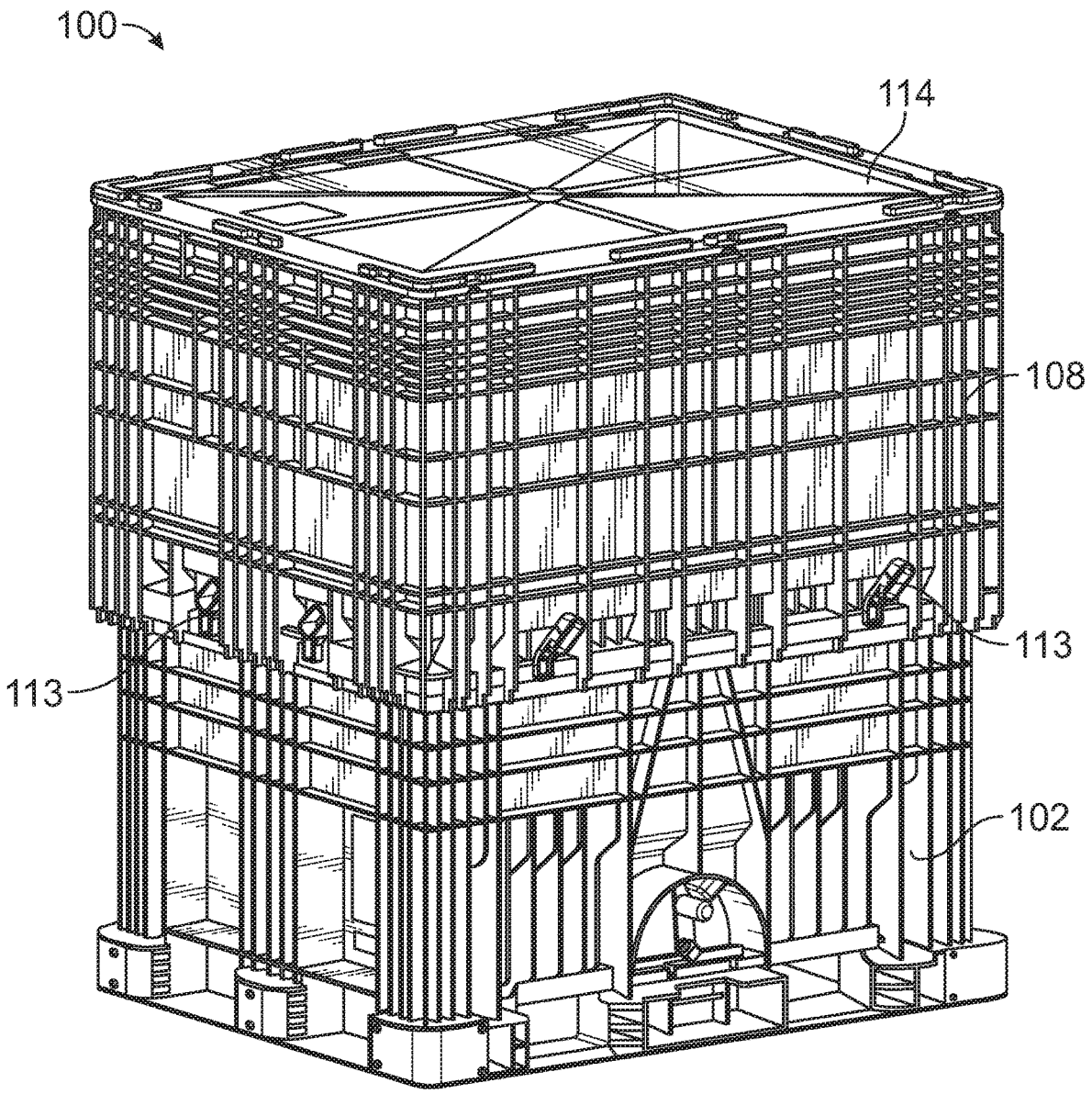
FIG. 1B (Prior Art)
FIG. 1B is a perspective view of the dispensing box in its "deployed" configuration with the ring seated on top of the base and with the ring covered.

FIG. 1B is a perspective view of the base portion 102, ring portion 108 and the cover 114 assembled together to form a complete or "deployed" dispensing box 100, which can be filled with flowable material by removing the cover 114 and pouring or otherwise loading material into the open top of the ring portion 108.

Figure 1C:
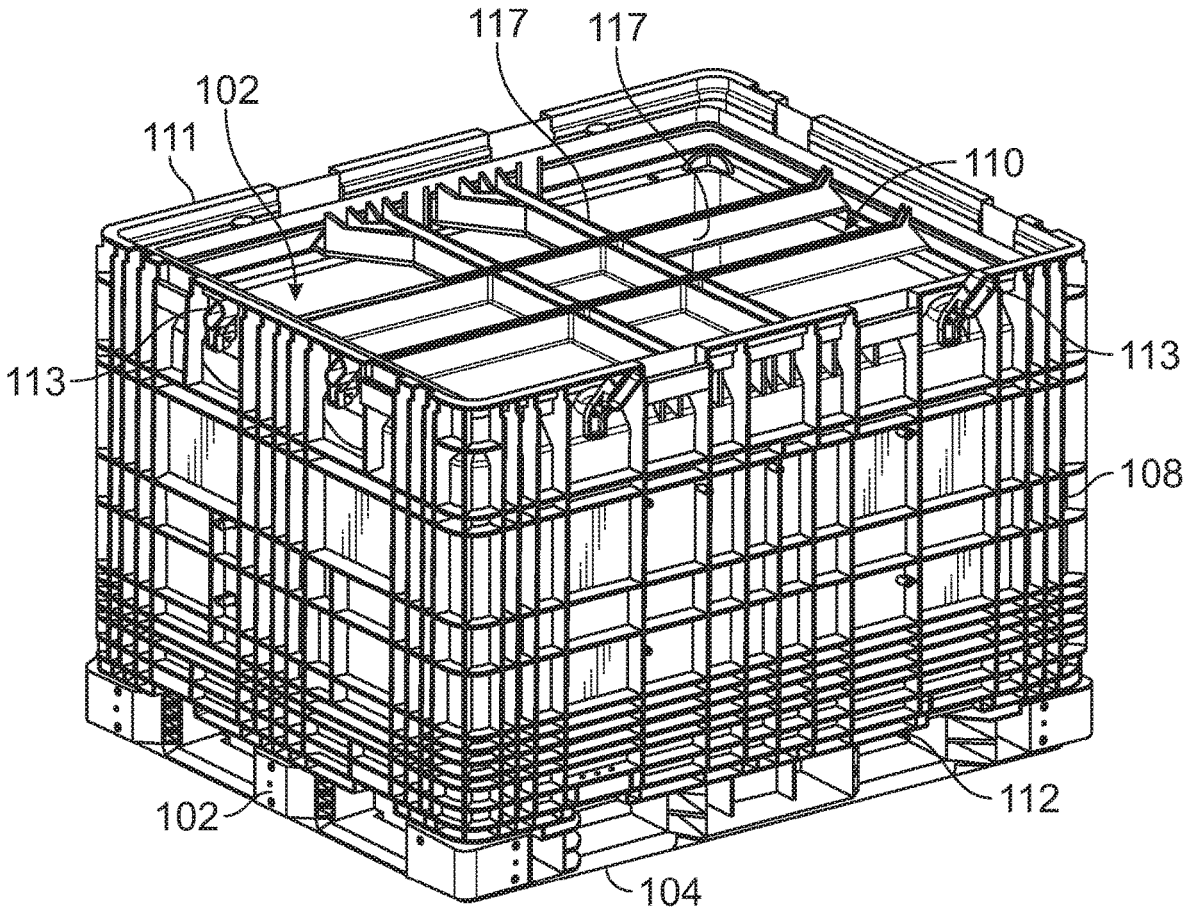
FIG. 1C (Prior Art)
FIG. 1C is a perspective view of the dispensing box "nested" albeit without a cover, i.e., with the ring inverted from the orientation that the ring is in in FIG. 1B and sliding the ring over the base and uncovered, revealing reinforcing ribs in the bottom of the ring.

FIG. 1C shows the ring portion 108 flipped over from the orientation shown in FIGS. 1A and 1B and slid over the base portion 102, albeit without the cover 114 to show reinforcing ribs 117 that extend across the open bottom 110. Flipping the ring portion 108 over and sliding it over the base portion 102 reduces the volume required to transport an empty dispensing box 100.

Figure 1D:
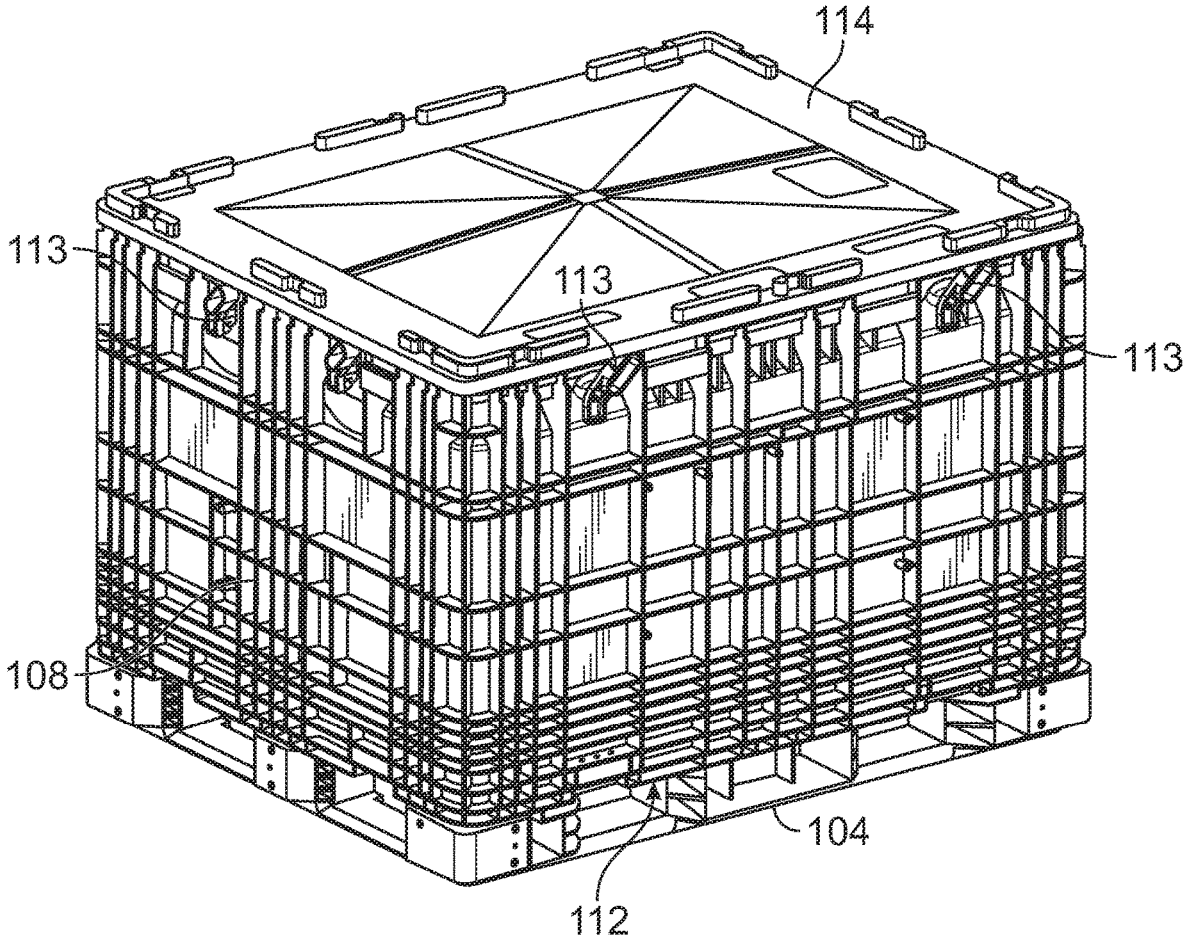
FIG. 1D (Prior Art)
FIG. 1D is a perspective view of the dispensing box "nested" with the cover installed over the bottom of the ring.

FIG. 1D shows the dispensing box with the cover 114 place over and covering the open bottom of the ring portion 108.

As mentioned above, the large size of the base portion 102 and the ring portion 108 are often not necessary for a particular shipment of flowable material. Unused space in a flowable material dispensing box wastes space in a shipping container and needlessly increases shipping costs. Similarly, when the volume of a single dispensing box 100 is inadequate to send a particular quantity of material to be shipped but that particular quantity is less than what could could be shipped in two dispensing boxes 100, the unused capacity of a second dispensing box is unnecessary.

As known in the art, prior art flowable material dispensing ring portions 108 have bottom edges that are essentially complementary, i.e., they are "complements" of the top edges of the base portions 102. The top and bottom edges of the ring are of different rectangular sizes such that prior art ring sections cannot be stacked on each other as can the extension collar 200 described and claimed herein.

The bottom edges of those ring portions 108 are provided with lock mechanisms that engage mortises formed in the top edges of the base portion 102. The lock mechanisms in the ring portions 108 and mortises in the base portion 102 are thus vertically aligned with each other such the mortise in the top edge of a base portion will be located directly above a lock mechanism in the bottom edge of the ring portion 108. The vertically aligned mortises and locks of a prior art flowable material dispensing box allow the portions to be stacked on top of each other and locked together.

Figure 2:
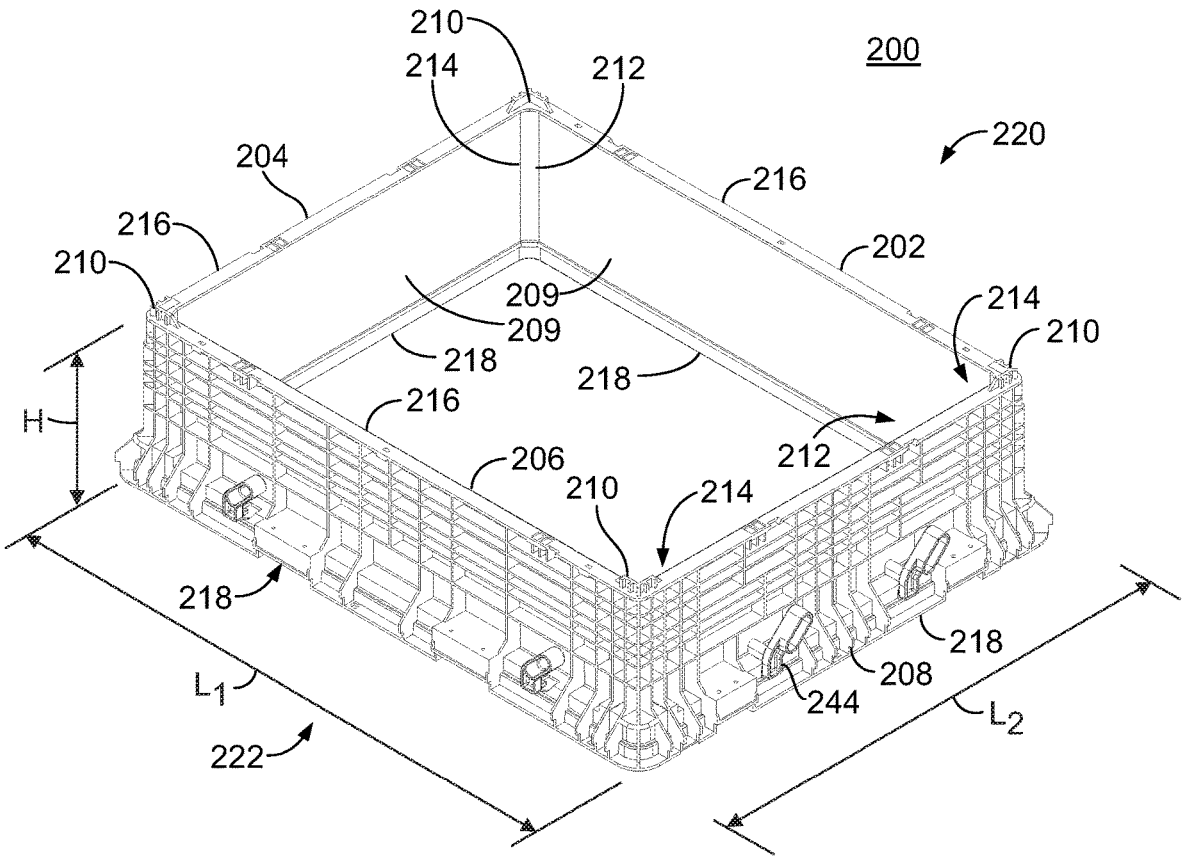
FIG. 2 is a perspective view of an extension collar for a flowable material dispensing box.

FIG. 2 is a perspective view of an extension collar 200 for use with a prior art flowable material dispensing box, such as the box shown in FIG. 1A as well as the prior boxes disclosed in the patents incorporated herein by reference. The extension collar 200 comprises four substantially planar and substantially upright or vertical side walls 202 204 206 208. The walls 202, 204, 206 and 208 have exterior surfaces that are provided with reinforcing ribs but are nevertheless considered herein to be "substantially planar" because the interior surfaces of the walls 209 are smooth and flat.

Each of the walls 202, 204, 206 and 208 have opposing ends 212 and 214. The space between those ends defines a nominal length. In the preferred embodiment as shown in FIG. 2, the walls have lengths, L1 and L2, which are unequal such that the extension collar 200 encloses a volume that is rectangular. In an alternate embodiment however, the lengths, L1 and L2, are equal such that the volume enclosed by the extension collar 200 would be square.

The adjacent pairs of the wall ends, identified by reference numerals 212 and 214, are considered herein to be "coupled" or connected to each other by corners 210. The walls and corners are preferably a molded plastic with the walls and corners actually being a continuous or unitary structure. For description and claim construction purposes, however, the corners 210, are considered herein to be quarter-circle segments and not part of the walls per se because their shape, when viewed from above, is a quarter circle. Each corner thus subtends an angle of about 90 degrees. Each corner 210 is curved, i.e., it has radius of curvature to reduce stress concentrations that would result by having the walls connected by sharp corners. The particular radius of curvature used with a particular dispensing box is a design choice.

Figure 3:
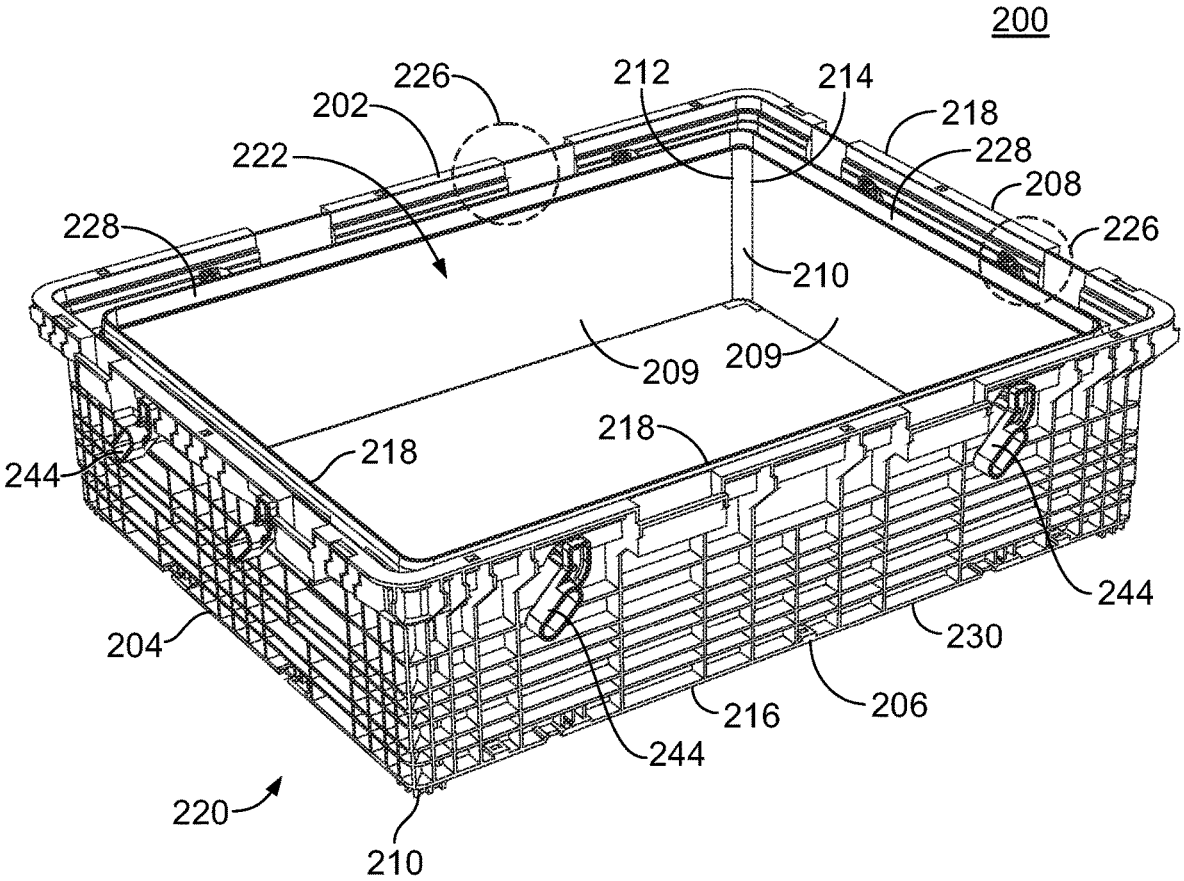
FIG. 3 is a bottom view of the extension collar shown in FIG. 2.

Still referring to FIG. 2, each wall 202, 204, 206 and 208 has a top edge identified by reference numeral 216 and a bottom edge 218. The walls also have a height, H, which is considered herein to be substantially equal to the spacing or distance between the top edge 216 and the bottom edge 218. In FIGS. 2 and 3, the height, H, of each wall is identical.

Most importantly, the extension collar 200 has opposing "ends" identified by reference numerals 220 and 222 which are open. Stated another way, the extension collar 200 has an open "top" identified by reference numeral 220 and an open "bottom" identified by reference numeral 222. Material can pass freely through the extension collar 200.

The height, H, and lengths, L1 and L2, define a volume enclosed by the walls 202, 204, 206 and 208 and the ends 220 and 222. Inasmuch as the extension collar 200 is configured to fit onto prior art flowable material dispensing boxes, the sidewall lengths, L1 and L2 are essentially standardized. The height, H, of the walls thus determines the volume that the extension collar 200 can hold when it is attached to a dispensing box for flowable material. Changing the height, H, of the walls of the collar 200 thus changes the volume of material that can be added into a prior art flowable material dispensing box by the addition of one or more extension collars 200 to the flowable material dispensing box. The height dimension is predetermined, i.e., determined beforehand, to achieve a desired enclosed volume of the extension collar 200.

Figure 4:
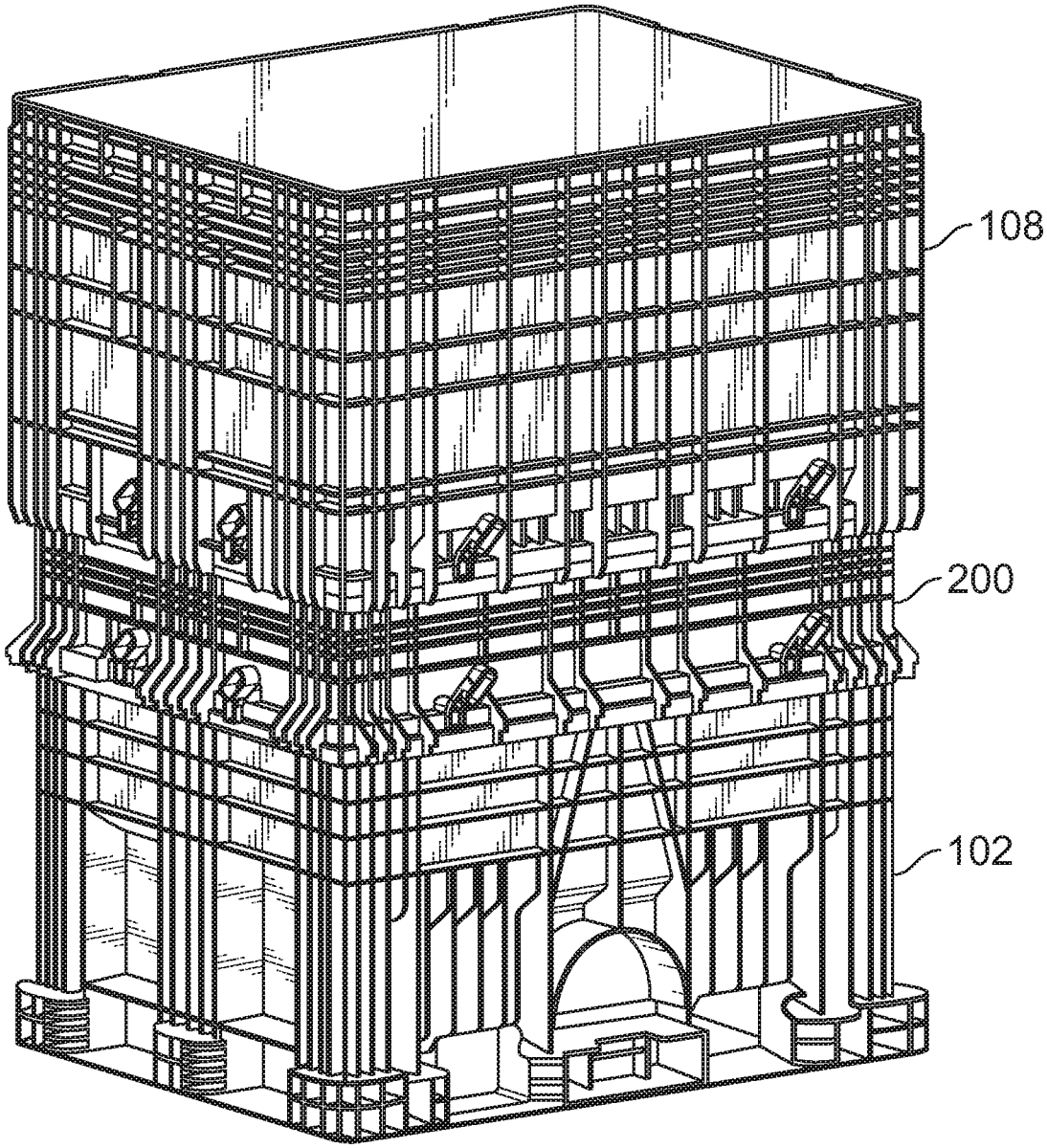
FIG. 4 depicts the use of the extension collar shown in FIG. 2 with a prior art dispensing box for flowable material shown in FIG. 1A-1D.
Figure 5:
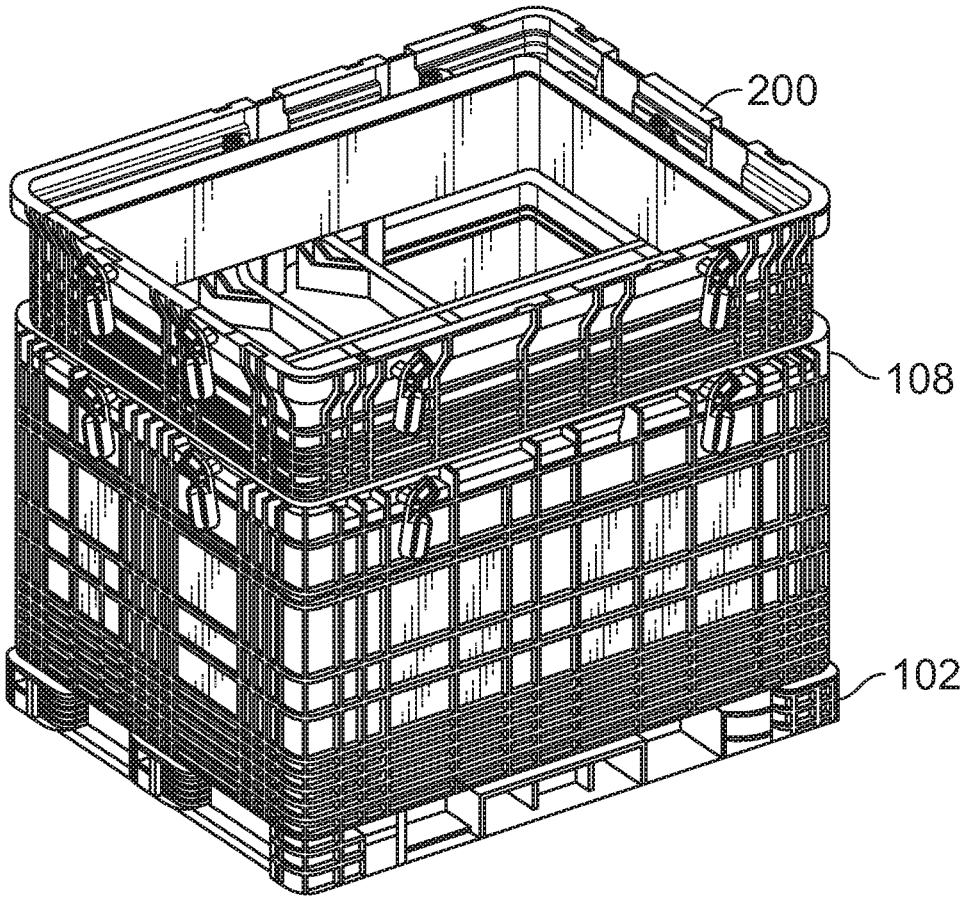
FIG. 5 depicts the storage attachment of the extension collar to the ring portion of a prior art dispensing box for flowable material shown in FIG. 1A-1D.

FIG. 4 depicts the extension collar 200 between a prior art base portion 102 and a prior art ring portion 108. The extension collar 200 incrementally increases the volume that can be kept inside a prior art dispensing box that consisted of only the base portion 102 and ring portion 108. The augmented prior art dispensing box shown in FIG. 4 is thus able to store more material than one prior art dispensing box but less than what could be stored in an entire second dispensing box. FIG. 5 depicts the extension collar 200 inverted and placed atop the inverted ring portion 108 for storage or shipping of the unloaded device shown in FIG. 4.

Figure 6:
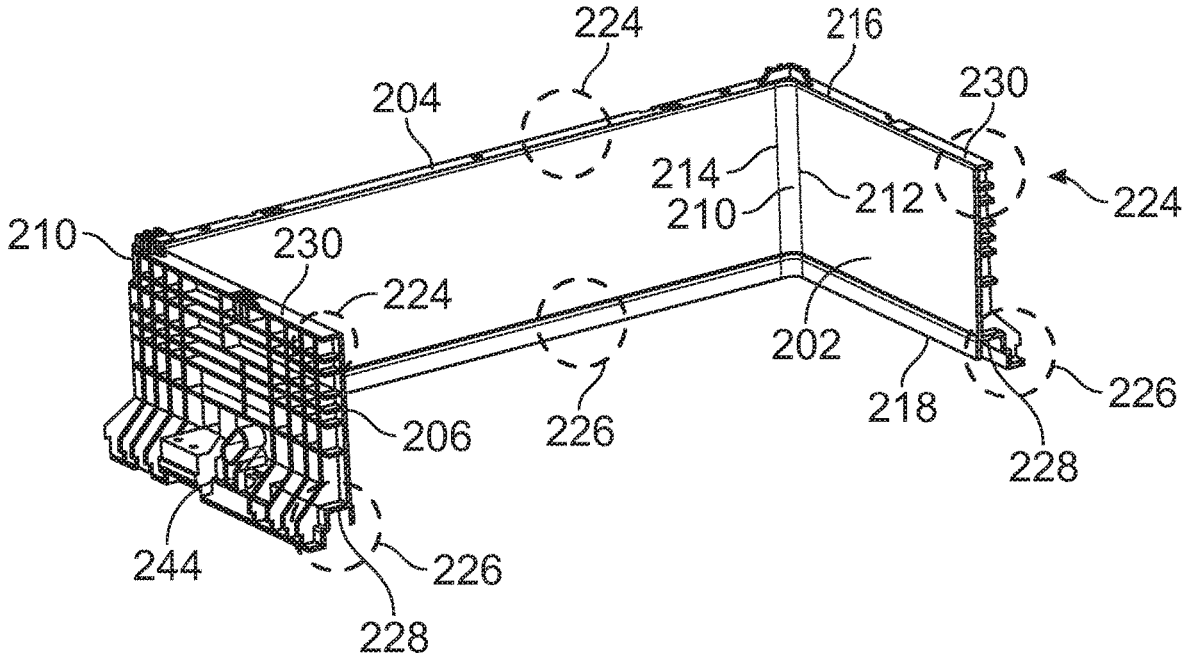
FIG. 6 is a cutaway view of the extension collar and which shows the cross-sectional shapes of the top and bottom edges of the extension collar.
Figure 7:
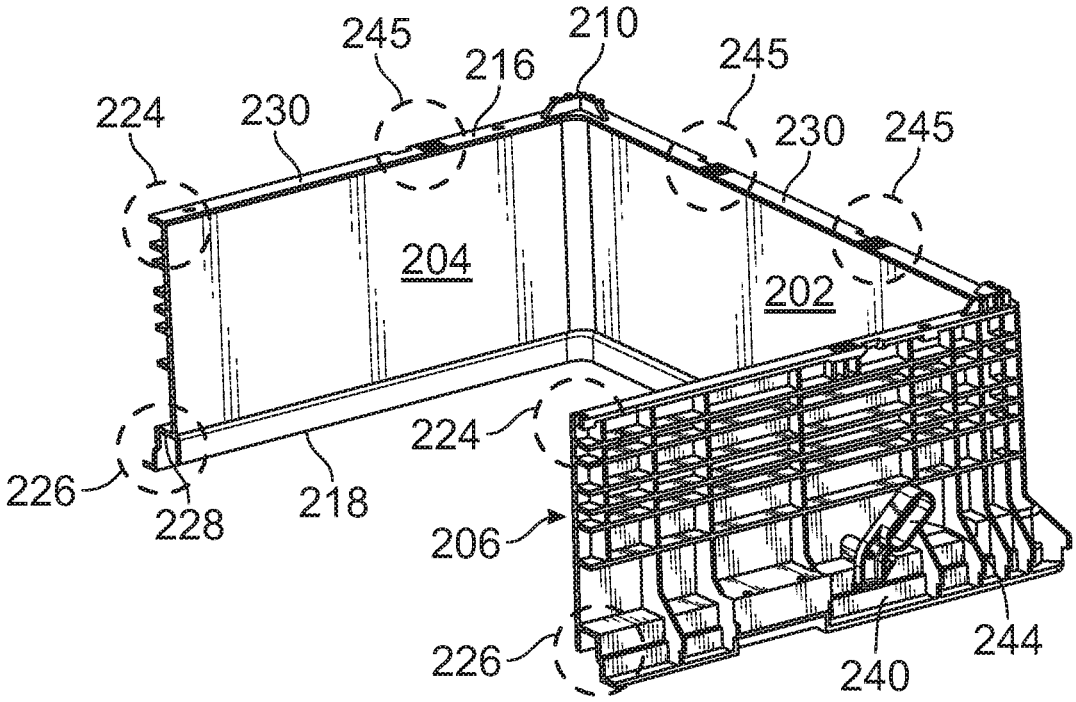
FIG. 7 is another sectional view of the extension collar shown in FIG. 2.

FIG. 6 and FIG. 7 are sectional views of the extension collar 200 shown in FIG. 2. Each wall 202, 204, 206 and 208 has a "top portion shown generally by reference numeral 224 and a bottom portion 226. The exterior surfaces of the walls have several stiffening ribs. The interior surfaces, however, are essentially smooth.

The bottom portion 226 of the collar 200 has a cross-sectional shape reminiscent of an inverted Arabic letter "U," albeit with a substantially flat or planar "top" edge, or, the Greek letter omega, with a substantially flat or planar "top" edge. The "inverted U" cross-sectional shape is considered herein to be "substantially concave" because it extends inwardly much like the shape inside of an inverted rain gutter or an inverted, flat-bottom trough.

The top edge portion 224 is considered herein to be a complement of the bottom portion because the cross sectional shape of the top portion 224 fits inside of and conforms to the shape of the substantially concave bottom portion 226. The top portion 224 is thus considered to be convex or "substantially convex."

The bottom portion 226 has a substantially flat or planar "top" surface identified by reference numeral 228. That top surface 228 of the bottom portion 226 is planar or at least substantially planar. It is also parallel or substantially parallel to a substantially planar top surface 230 of the convex top edge portion 224.

The top edge portion 224 and the bottom edge portion 226 are sized and shaped such that the top edge portion 224 fits inside the second or bottom edge portion 226 with a clearance fit, thus allowing the extension collar 200 to be added onto and removed from a flowable material dispensing box without tools or special equipment. The two planar surfaces 228 and 230 are parallel and face each other when the top edge portion 224 is inserted inside the bottom edge portion as happens when the extension collar 200 is placed on top of a base portion of a prior art flowable material dispensing box, such as the one shown in FIG. 1A.

Figure 8:
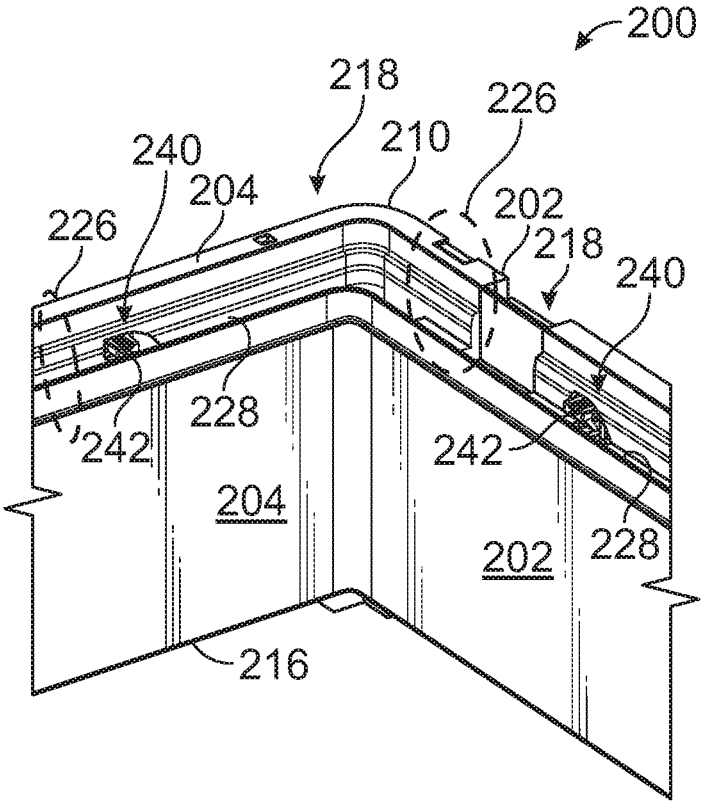
FIG. 8 is an isolated view of a corner of the bottom edge of the extension collar showing portions of two side walls and portions of a lock or latch used to attach the extension collar to a dispensing box for flowable material or to another extension collar.

FIG. 8 is an isolated view of one corner 210 of the extension collar 200, viewed from the bottom of the extension collar 200. The corner 210 depicted in FIG. 8 is the corner 210 located between the side wall identified by reference numeral 202 and the side wall identified by reference numeral 204.

The bottom edge portion 226 is provided with pockets 240, which are sized and shaped to enclose rotatable latches or locks, which have pad lock-like "shackles" 242. The shackles 242 can be rotated between an extended position, shown in FIG. 8, and retracted position by rotation of handles 244 on the outside surfaces of the walls 202, 204, 206 and 208. See also FIG. 9.

In the extended position, the shackle 242 is above the flat surface 228. The shackle is located below the flat surface 228 when in its retracted position. When the shackle is rotated from the retracted to the extended position, it can engage a mortise 245 in top edge of a prior art flowable material dispensing box.

Figure 10:
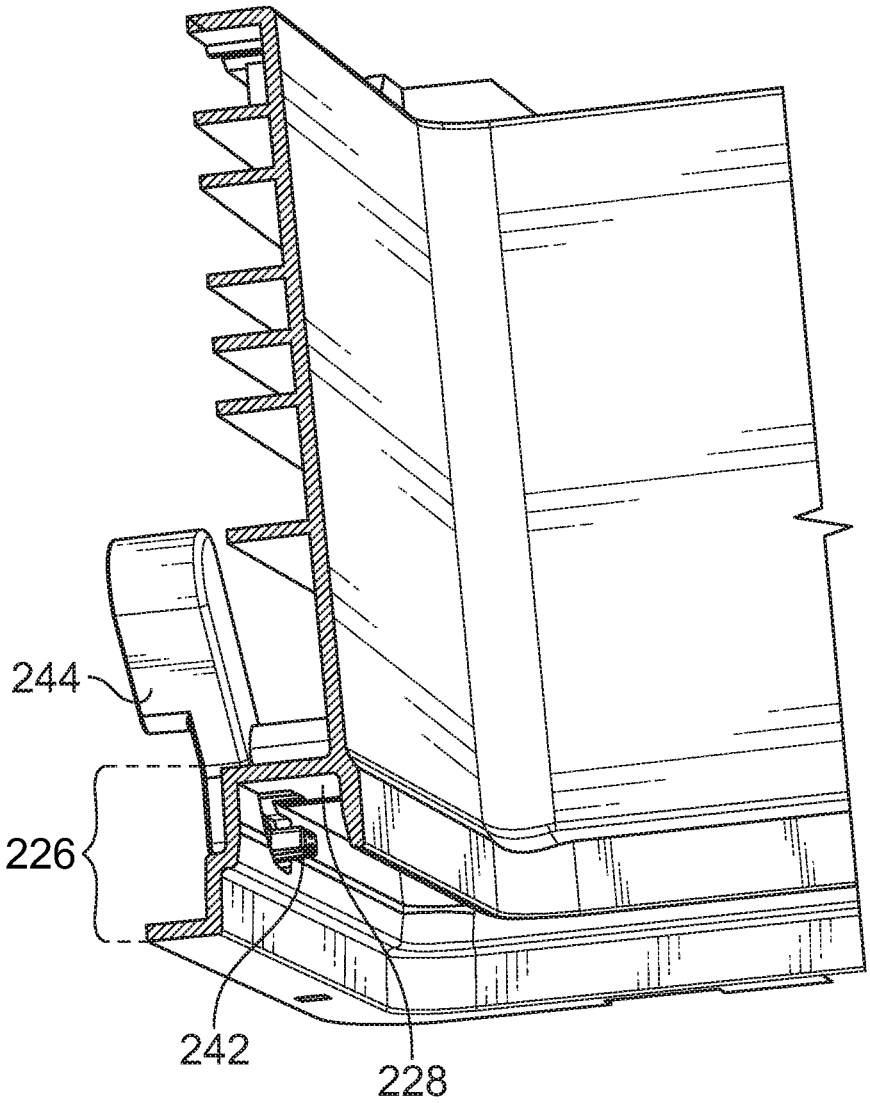
FIG. 10 is an isolated view of the lock or latch adjacent to a corner that connects two walls together as seen from the bottom of the extension collar.

The portion of the shackle 242 shown in the figures is considered herein to be the "toe" portion. In FIG. 10, which is a bottom view of the extension collar viewed from below, the toe portion is in its "extended" position, i.e., out of the pocket 240 and "below" the substantially planar top surface 228 of the bottom edge portion 226.

Whether the toe portion of the shackle 242 is "above" or "below" the top surface 228 depends on the perspective from which the surface is viewed. Regardless, when the toe portion is extended out of the pocket 240 and thus "away" from the surface 228, the shackle can extend into and engage a mortise 245 in the substantially planar top surface 230 of the top edge portion 224 of the sidewalls of a prior art flowable material dispensing box.

Figure 9:
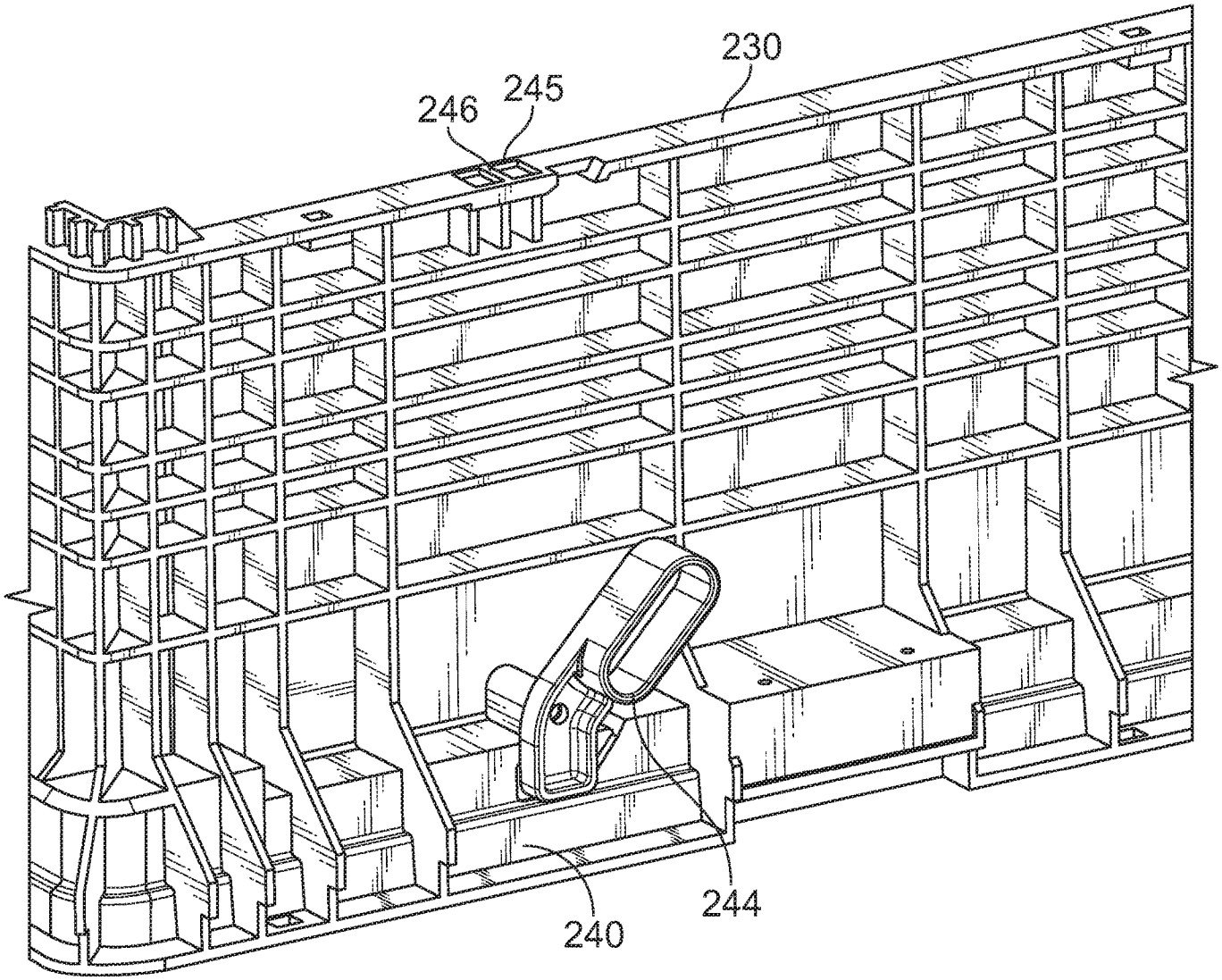
FIG. 9 is an isolated view of the outside corner of the extension collar depicting a control lever for the latch shown in FIG. 8, as well as depicting isolated portions of the top edge of the extension collar including a mortise into which the shackle portion of the latch engages.
Figure 11:
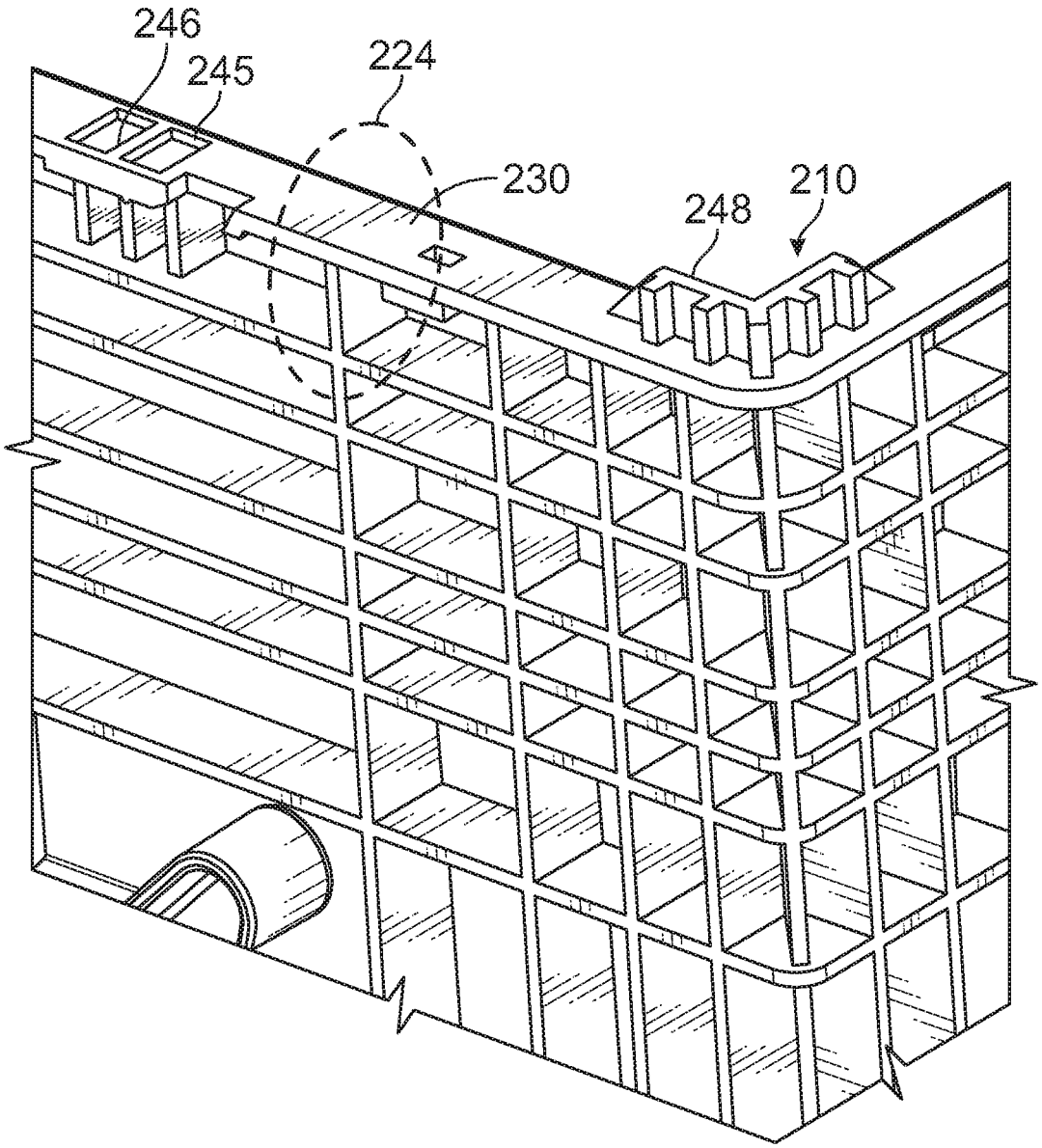
FIG. 11 is an isolated view of the top edge of the extension collar showing a mortise in the top edge, a quarter-circular section connecting the two walls.

The mortises 245, which are shown in both FIG. 9 and FIG. 11, has a bar 246, around which the shackle toe 242 is able to wrap itself and thus lockingly engage the mortise 245 and the bar 246. Stated another way, the shackle is locked to the bar and vice versa when they mechanically engage each other.

FIG. 11 shows the top edge portion 230 of a wall, including locating tabs 248 that extend above the top of the corner portion 210. The locating tabs 248 are sized, shaped and arranged to fit into complementary and mating mortises formed in the bottom edge of a flowable material dispensing box, such as the one shown in FIG. 1A.

In order for the extension collar 200 to fit onto and lock to a flowable material dispensing box, or perhaps another extension collar 200, the mortise 245 on the top edge 230 is located directly above the pocket 240 enclosing a latch and shackle 242. Stated another way, the mortises and shackles are located at the same place between opposing ends of the sidewalls. The shackle on a bottom edge of the extension collar is thus located to engage a mortise 245 at the same place on the top edge of the base of a flowable material dispensing box.

In the embodiment shown in FIG. 4, a single extension collar 200 is placed between a base portion 102 and a ring portion 108 of a prior art flowable material dispensing box. Those of ordinary skill in the art should recognize that two or more extension collars 200 could be stacked on top of each other and placed between those two portions of a prior art dispensing box.

In as much as the top edge of the extension collar 200 is configured to mate with the bottom edge of a prior art flowable material dispensing box, the top edge 216 of the extension collar 200 is also capable of receiving a mating cover, such as the ones shown in the prior art references incorporated herein by reference.

In the preferred embodiment of the extension collar 200, the lengths, L1 and L2, are unequal. The cross-sectional shape of such an extension collar is thus rectangular. In alternate embodiments, the lengths of the walls, L1 and L2 are the same such that the cross-section shape of the extension collar 200 is square.

Figure 12:
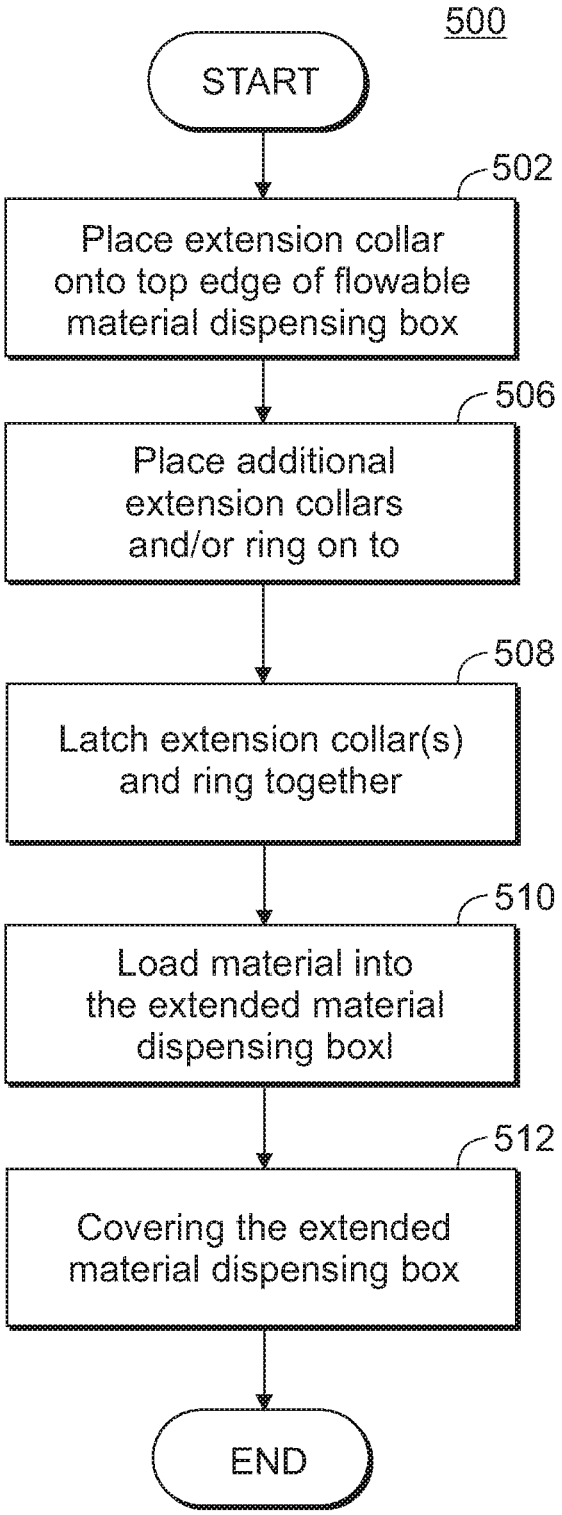
FIG. 12 is a flowchart, depicting steps of a method of using the extension collar.

Finally, a method 500 of adding enclosed and secured volume to a flowable material dispensing box is shown in FIG. 12. In a first step 502 an extension collar, such as the extension collar shown in FIG. 2, is placed on the top edge portion of the four walls of a dispensing box base portion 102, such as the base portion shown in FIG. 4 or a base portion shown in one of the prior art references incorporated by reference. Such an extension collar has of course an open top, an open bottom and four side walls and, unlike a prior art ring, the extension collar can be stacked onto other extension collars. The four side walls of the extension collar have a height, which is predetermined to provide whatever additional storage volume might be required.

The first step 502 can also include of course an additional step, not shown in FIG. 12 for brevity, wherein the extension collar is locked in place by rotating a latch, such as a shackle 242 depicted in the figures, into engagement with mortise in the top edge of a walls of the dispensing box.

In an optional second step 506, one or more additional extension collars are placed onto the first extension collar that was put in place at step 502. An additional extension ring can be placed on top of the "first" extension collar. As with step 502, step 506 can include corresponding locking steps for each additional extension collar.

In a third step 508, the one or more extension collar(s) and the ring and base portions are latched together, unless of course they were latched together as part of steps 502 and 506. Stated another way, if steps 502 and 506 are modified to include latching the extension collars, step 508 would of course be unnecessary.

In a fourth step 510, the flowable material dispensing box and the extension collar(s) are loaded with a desired volume of material.

In the last step 512, the extended dispensing box is covered.

For claim construction purposes, the term "affixing" should be construed to include both the single action of placing an extension collar onto an dispensing box as well as the combined action of placing and latching an extension collar to a dispensing box.

While an extension collar 200 for a flowable material dispensing box will typically enclose a volume less than that of a prior art flowable material dispensing box, those skilled in the art should recognize that the enclosed volume of the extension collar 200 could also be greater than the volume enclosed by a prior art flowable material dispensing box simply by changing the height, H, of the extension collar walls.

For purposes of compatibility, the bottom edge of the extension collar 200 is of course sized, shaped and arranged or "configured" to receive and engage a cover that fits the top and bottom of a prior art ring portion 108 of a flowable material dispensing box 100.

The foregoing description is for purposes of illustration only. The true scope of the invention is set forth in the following claims.

What is claimed is:

1. An extension collar for a flowable material dispensing box, the extension collar comprising:

four substantially planar walls, which are connected to each other to form a length of rectangular tube having an open top end and an opposing open bottom end, the rectangular tube having a top edge portion and a bottom edge portion, each wall having a height defined by the distance between the top and bottom edge portions, each wall having first and second opposing ends, each wall also having a length defined as the distance between the first and second opposing ends, the heights of each wall being substantially the same, the heights and lengths of the walls determining a volume enclosed by the four walls and the open top end and the open bottom end of the rectangular tube;

the bottom edge portion having an inverted U-shaped cross sectional shape with a substantially planar top surface; and the top edge portion having a cross sectional shape with a substantially planar top surface;

wherein the cross sectional shape of the top edge portion is configured to fit inside and be a complement of the cross sectional shape of the bottom edge portion.

2. The extension collar of claim 1, further comprising:

a shackle proximate the bottom edge portion of the rectangular tube, the shackle being sized and shaped to engage a mortise, the shackle having an extended position wherein a toe portion of the shackle is away from the top surface of the bottom edge portion responsive to rotation of the shackle, the shackle having a retracted position whereat the toe is located substantially above the substantially planar top surface of the bottom edge portion; and a mortise formed in the top edge portion.

3. The extension collar of claim 1, wherein the extension collar is configured to be stacked on top of a base portion of a flowable material dispensing box, the base portion having a closed bottom with flow control door, four walls and an open top, the open top of the base portion of the dispensing box having a top edge portion formed to have a cross sectional shape that is substantially the same as the cross sectional shape of the top edge portion of the extension collar, and wherein the base portion of the flowable material dispensing box is configured to be attached to the bottom edge portion of the extension collar.

4. The extension collar of claim 1, wherein the extension collar is configured to be stacked under a ring portion of a flowable material dispensing box, the ring portion having four walls an open top and an open bottom, the open bottom of the ring portion of the dispensing box having a bottom edge portion configured to have a cross sectional shape that is substantially the same as the cross sectional shape of the bottom edge portion of the extension collar, and wherein the ring portion of the flowable material dispensing box is configured to be attached to the top edge portion of the extension collar.

5. The extension collar of claim 3, wherein the walls of the extension collar are connected to each other by quarter-circle segments having a first radius of curvature.

6. The extension collar of claim 3, wherein the top edge portion of the extension collar is configured to receive and engage a cover that also fits the top of a base portion of a flowable material dispensing box.

7. The extension collar of claim 3, wherein the bottom edge portion of the extension collar is configured to receive and engage a cover that also fits the top and bottom of a ring portion of a flowable material dispensing box.

8. The extension collar of claim 1, wherein the four substantially planar walls comprise a first wall, a second wall, a third wall, and a fourth wall, wherein the first and second walls are configured to oppose each other and have a first length and wherein the third and fourth walls are configured to oppose each other and have a second length, the first and second lengths being substantially the same to form an extension collar that is substantially square.

9. The extension collar of claim 3, wherein the flowable material dispensing box has a first predetermined volume and wherein the wall heights and lengths of the extension collar enclose a second volume that is less than the first predetermined volume.

10. The extension collar of claim 3, wherein the flowable material dispensing box has a first predetermined volume and wherein the wall heights and lengths of the extension collar enclose a second volume that is greater than the first predetermined volume.

11. The extension collar of claim 1, wherein the extension collar is configured to be stacked with at least one additional extension collar.

* * * * *